US006854280B2

(12) United States Patent
Jeuch

(10) Patent No.: US 6,854,280 B2
(45) Date of Patent: Feb. 15, 2005

(54) METHOD FOR MAKING A SELF-REFRIGERATING DRINK PACKAGE AND EQUIPMENT THEREFOR

(75) Inventor: Pierre Jeuch, Saint-Aubin (FR)

(73) Assignee: Thermagen S.A., Gif-sur-Yvette (FR)

( * ) Notice: Subject to any disclaimer, the term of this patent is extended or adjusted under 35 U.S.C. 154(b) by 0 days.

(21) Appl. No.: 10/239,824

(22) PCT Filed: Jun. 13, 2001

(86) PCT No.: PCT/FR01/01820

§ 371 (c)(1),
(2), (4) Date: Dec. 13, 2002

(87) PCT Pub. No.: WO01/96796

PCT Pub. Date: Dec. 20, 2001

(65) Prior Publication Data

US 2003/0115901 A1 Jun. 26, 2003

(30) Foreign Application Priority Data

Jun. 13, 2000 (FR) ..... 00 07530

(51) Int. Cl.[7] ..... F25B 19/00
(52) U.S. Cl. ..... 62/100; 62/269; 62/294
(58) Field of Search ..... 62/294, 371, 372, 62/451, 480, 4, 100, 268, 269

(56) References Cited

U.S. PATENT DOCUMENTS

| | | | | | |
|---|---|---|---|---|---|
| 3,970,068 | A | * | 7/1976 | Sato | 126/263.08 |
| 4,319,464 | A | * | 3/1982 | Dodd | 62/371 |
| 4,669,273 | A | * | 6/1987 | Fischer et al. | 62/294 |
| 4,688,395 | A | * | 8/1987 | Holcomb | 62/294 |
| 4,736,599 | A | * | 4/1988 | Siegel | 62/294 |
| 4,784,678 | A | * | 11/1988 | Rudick et al. | 62/4 |
| 5,201,183 | A | * | 4/1993 | Ramos | 62/4 |
| 5,207,073 | A | * | 5/1993 | Maier-Laxhuber et al. | 62/269 |
| 5,214,933 | A | * | 6/1993 | Aitchison et al. | 62/294 |
| 5,331,817 | A | * | 7/1994 | Anthony | 62/5 |
| 5,440,896 | A | | 8/1995 | Maier-Laxhuber et al. | |
| 5,447,039 | A | | 9/1995 | Allison | |
| 5,692,381 | A | * | 12/1997 | Garrett | 62/60 |
| 5,765,385 | A | * | 6/1998 | Childs | 62/293 |
| 5,865,036 | A | * | 2/1999 | Anthony | 62/293 |
| 5,946,930 | A | | 9/1999 | Anthony | |
| 6,065,300 | A | | 5/2000 | Anthony | |

FOREIGN PATENT DOCUMENTS

| | | | |
|---|---|---|---|
| EP | 0 726 433 A1 | | 8/1996 |
| EP | 0 931 998 A2 | | 7/1999 |
| FR | 2 696 533 A1 | | 4/1994 |
| JP | 2001139829 A | * | 5/2001 |
| WO | WO 97/21964 A1 | | 6/1997 |
| WO | WO 99/37958 A1 | | 7/1999 |

* cited by examiner

*Primary Examiner*—William E. Tapolcai
*Assistant Examiner*—Mohammad M. Ali
(74) *Attorney, Agent, or Firm*—Sughrue Mion, PLLC

(57) ABSTRACT

The invention relates to a method for manufacturing a self-refrigerating drinks package, characterised in that it includes a step consisting in assembling refrigeration means inside the package, said refrigeration means being composed of a cavity containing a refrigerating liquid able to evaporate under the effect of a negative pressure, means of connecting said cavity to external pumping means by adsorption being provided in the package, partial pressure of the non-adsorbable gases in the internal cavity being maintained below 3 millibar.

15 Claims, 3 Drawing Sheets

SECTION A – A

SECTION B – B

SECTION A – A

SECTION B – B

METHOD FOR MAKING A SELF-REFRIGERATING DRINK PACKAGE AND EQUIPMENT THEREFOR

The present invention relates to a method for manufacturing a self-refrigerating drinks package, as well as equipment for implementing such a method. The invention applies particularly to the cooling of drinks contained in a closed package of the can or bottle type.

The object of the present invention is to propose a method for manufacturing a drinks package allowing the rapid cooling of the drink for its consumption at an ideal temperature in any place and at any time.

In particular, the invention proposes such a manufacturing method which is simple to implement and profitable in the context of industrial exploitation.

There are mainly two physical methods for cooling a package or enclosure. Firstly, cooling by the expansion of a gas according to classic thermodynamic laws, and secondly cooling by evaporation and adsorption, the principle of which consists in evaporating a liquid under the effect of a negative pressure maintained by adsorption of the vapours from said liquid.

Thus, for example, the first method was used in the French patent application FR 97 04531, which proposes to achieve the cooling of a drink in a can by means of a depressurisation of compressed gas. A cartridge of gas to be depressurised is placed in a metallic radiator itself placed inside the can.

This solution has several drawbacks. Firstly, the gas cartridge occupies approximately half the volume of the drink to be cooled, which is necessitated by the quantity of gas required for the cooling of the drink. Secondly, the cost price of a compressed gas cartridge is high, which gives rise to an excessively high increase in the price of the can.

The use of the other method for cooling by evaporation and adsorption also has been the subject of many researches in the prior art. Many devices have been proposed, combining an evaporator containing a liquid to be evaporated with a reservoir containing an adsorbent.

Thus, for example, such a method was used in self-contained devices such as portable refrigerators. The patent U.S. Pat. No. 4,205,531, an illustration of which is given in FIG. 1, proposes a refrigeration system in two parts. An evaporator 101, consisting of a chamber containing a liquid 103 to be evaporated, is situated inside an enclosure 100 and another chamber 102 containing the adsorbent 104 is situated outside. The two chambers 101 and 102 are connected by a conduit 110 provided with a valve 111. An electric cable 105 is also provided in the external chamber 102 in order to heat and thus regenerate the adsorbent 104. Another conduit 112 connects the evaporator 101 to a vacuum pump by means of the conduit 110 and a valve 113.

This patent claims the control of a pressure in the evaporator which is much less than the saturation vapour pressure of the liquid by means of a vacuum pump. No indication is however given on the way of reducing the partial pressure in the evaporator 101 without making the refrigerating liquid 103 evaporate completely, which constitutes a real physical difficulty.

In addition, this device is complex to manufacture (valves, tubes and cables) and is not inexpensive, in particular in order to guarantee a good vacuum.

In addition, use of the method for cooling by evaporation and adsorption has also been proposed for drinks packages.

Thus the patent U.S. Pat. No. 4,736,599, an illustration of which is given in FIG. 2, proposes to produce an exchanger

16 (evaporator) contained completely inside the receptacle 10 to be cooled (explicitly described as a can) but emphasises the reversible character of the putting of the exchanger 16 in communication with the adsorbent contained in a reservoir 22 situated under the can 20. This device includes at least four valves: two for making the vacuum 19 and then filling 20 the exchanger 16, one for making the vacuum in the reservoir 22 of the adsorbent and one for controlling the triggering of the cooling 27. This complex construction certainly does not make it possible to achieve a cost price compatible with a disposable package such as a can and the reversible character of the putting in communication contributes to this complexity.

Other patents, U.S. Pat. No. 4,759,191, supplemented by U.S. Pat. No. 5,048,301, by the same inventors, an illustration of which is given in FIG. 3, propose to achieve the refrigeration of a drink 15 contained in a package 10 by means of a module 11 placed in the package 10 (presented as a can).

This module 11 is composed of several chambers, a first 12 which contains the liquid to be evaporated (water) and a second chamber 14, internal to the first 12, containing desiccants 25 and "heat traps" 24. Triggering means make it possible to put the water 18 in contact with the desiccants 25, which act as a pump for the water vapour. This adsorption reaction, which cools the first chamber 12, does however cause a significant release of heat in the second chamber 14, which can be trapped in the special materials 24 (by change of phase or endothermic reaction). The second patent U.S. Pat. No. 5,048,301 proposes in this regard to add heat insulation (of the Dewar type) by means of a vacuum chamber 13 surrounding the chamber 14 containing the adsorbent 25.

None of the inventions of the prior art has been the subject of significant commercial application up to the present time. There are for this technical reasons of performance and economic reasons of manufacturing cost, for which the present invention proposes solution.

This is because some technical and physical requirements have never been seriously taken into consideration in the prior art, and the constraints of manufacturing cost are important given the application to disposable devices.

The complexity of the devices proposed in the prior art constitute an obvious obstacle to their development. The reversible valves putting in communication in the patent U.S. Pat. No. 4,736,599, although not described in detail, are complex and expensive to manufacture. The patents U.S. Pat. Nos. 4,759,191 and 5,048,301 suffer from the same economic constraint and also emphasise the difficulty of discharging the heat released in the package by the adsorbent and the complex means to be used for this.

In addition, these devices do not make it possible to achieve rapid cooling of the drink. Two essential points for such a rapid cooling have in fact been insufficiently taken into consideration. Firstly the efficacy of the heat exchange between the evaporator and the drink, and secondly the speed of pumping of the vapours from the refrigerating liquid in the evaporator.

The pumping speed of course depends on the efficacy of the adsorbent, but also on the geometric characteristics of the means of putting the evaporator in communication with the reservoir containing the adsorbent, as well as the residual pressure of the non-adsorbable gases, that is to say gases other than the vapour from the refrigerating liquid.

However, none of the devices of the prior art proposes particular arrangements for providing a good vapour pumping rate.

In addition, the devices of the prior art rarely present their manufacturing methods and in particular the way of ensuring a good vacuum in the exchanger.

The patent U.S. Pat. No. 4,736,599 describes a valve structure which makes it possible to make the vacuum before introducing the refrigerating liquid into the exchanger. This method is certainly effective, but results in a complex and expensive device through the number of valves which it includes.

The patents U.S. Pat. Nos. 4,759,191 and 5,048,301 do not specify the way of eliminating the air from the chamber containing the refrigerating liquid at the time the device is manufactured.

However, it is the residual pressure of the non-adsorbable, and therefore non-pumped, gases which limits the cooling process.

The objective of the present invention is to resolve the drawbacks of the prior art.

The object of the present invention is to propose a manufacturing method which makes it possible to achieve the rapid cooling of a drink in its package with a simple and inexpensive device.

To this end, the invention proposes a method for manufacturing a self-refrigerating drinks package which is composed of two distinct elements. An evaporator (a cavity) containing a refrigerating liquid is disposed inside a package and connection means are provided for connecting the evaporator to pumping means external to the package which make it possible to cause and maintain the evaporation of the refrigerating liquid.

In addition, the method for manufacturing the drinks package according to the invention makes it possible to maintain the pressure of the non-adsorbable gases in the evaporator at a low level, below 3 millibar.

The present invention relates more particularly to a method for manufacturing a self-refrigerating drinks package, characterised in that it includes a step consisting in assembling refrigeration means inside a package, said refrigeration means being composed of a cavity containing a refrigerating liquid able to evaporate under the effect of a negative pressure, means of connecting the said cavity to external pumping means by adsorption being provided in the package, the partial pressure of the non-adsorbable gases in the internal cavity being maintained below 3 millibar.

According to the methods of implementation, the refrigerating liquid is water or water containing an additive reducing its solidification temperature.

According to one characteristic, the refrigerating liquid partially fills the internal cavity.

According to another characteristic, the refrigerating liquid was degassed prior to its introduction into the internal cavity.

According to one particularity, the step of assembling the internal cavity inside the packaging is carried out with the cavity containing the frozen refrigerating liquid.

According to one embodiment, the method includes the following steps:

producing at least part of a cavity, filling the said cavity with the refrigerating liquid, freezing the said liquid, assembling the cavity in the package provided with connection means.

According to another embodiment, the refrigerating liquid is frozen in a shape fitting in the cavity, and then placed in the said cavity before it is assembled in the package.

According to one characteristic, the connection means consist of a conical structure closing the cavity and having a seal-removal recess.

According to one embodiment, the connection means are produced in the bottom of the package.

According to another embodiment, the connection means are produced in the lid of the package.

According to one embodiment, the connection of the internal cavity to the package is carried out by cold crimping.

According to another embodiment, the connection of the internal cavity to the package is carried out by adhesive bonding.

According to one embodiment, the connection of the cavity in the package is carried out under air vacuum.

According to another embodiment, the connection of the cavity in the package is carried out at atmospheric pressure, the method also including a step of pumping the cavity before closing the said cavity.

The invention also concerns equipment for implementing the method, characterised in that it includes:

means of freezing a refrigerating liquid, means of assembling a cavity containing the frozen refrigerating liquid in a package, means of producing vacuum in the cavity.

The internal cavity and the external pumping means constitute two distinct elements independent in their design and manufacture. Thus the manufacture of a self-refrigerating package is greatly simplified since it contains only an evaporator and connection means. The manufacturing lines for conventional packages can therefore easily be adapted.

According to one advantageous particularity, the self-refrigerating drinks package obtained by the manufacturing method according to the invention contains no filling or pumping valve, which simplifies manufacture and reduces the production costs.

Other particularities and advantages of the present invention will emerge during the following description given by way of illustrative and non-limiting example, and made with reference to the figures, in which:

FIG. 1, already described, is a diagram of a portable self-refrigerating device according to the prior art, FIG. 2, already described, is a diagram of a self-refrigerating drinks can according to a variant of the prior art;

FIG. 3, already described, is a diagram of a self-refrigerating drinks can according to another variant of the prior art;

Figure 6A:
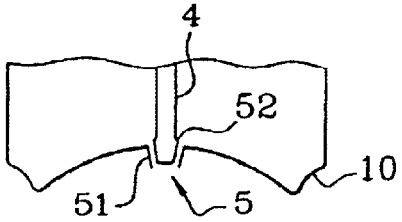
Figure 6B:
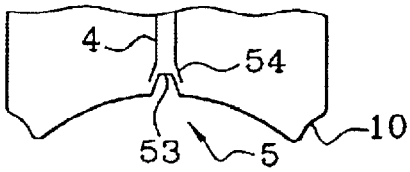
Figure 7:
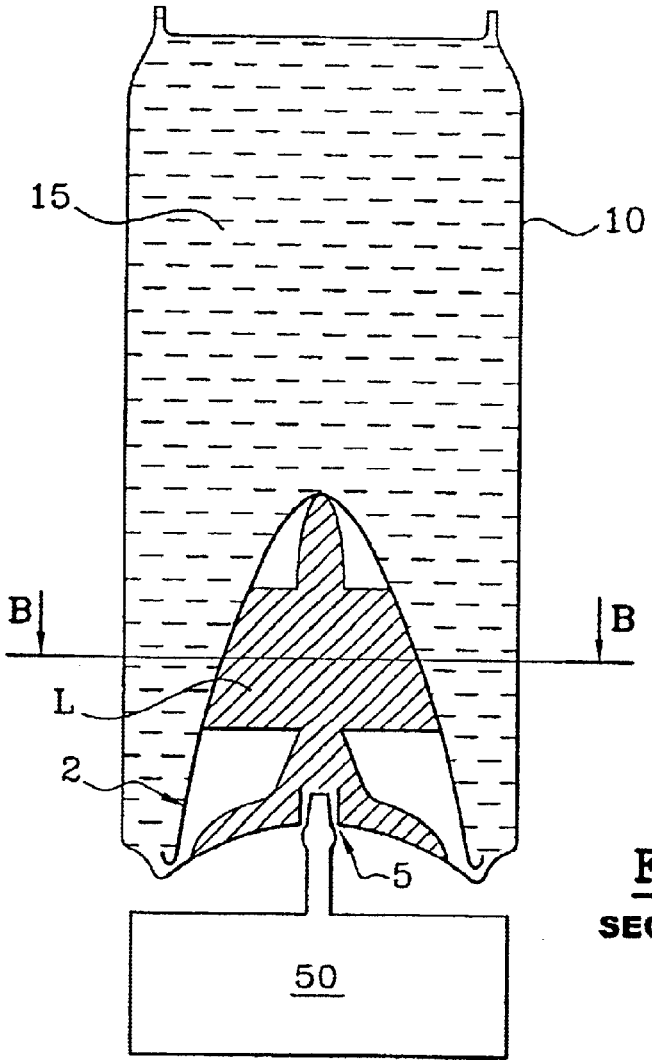
Figure 8:
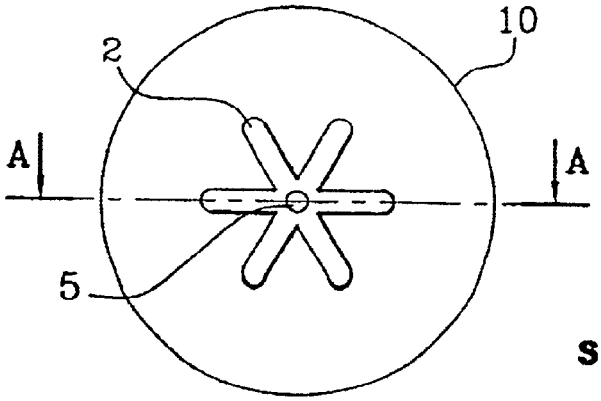

FIGS. 6*a* and 6*b* are detailed views of the connection means;

FIG. 7 is a schematic view, in transverse section along AA, of a drinks package according to a second embodiment of the invention;

FIG. 8 is a schematic view from below along BB in FIG. 4.

The description which follows relates to a method for manufacturing a drinks package, of the can type, made from steel or aluminium according to the manufacturer, provided with refrigeration means based on the principle of evaporation of a refrigerating liquid at reduced pressure.

The method according to the invention consists in manufacturing a heat exchanger 2 and placing it inside a drinks package, consisting of a can 10 of standard shape and volume. This heat exchanger is produced in the form of a cavity 2 which is filled with a refrigerating liquid L.

In order to facilitate its manufacture and recycling, the cavity 2 is advantageously composed of the same material as the can 1, namely steel or aluminium.

According to the method of the invention, the cavity 2 is produced separately and then assembled in the package 10 whilst enclosing the refrigerating liquid L. For such an operation to be possible, the invention proposes to perform the assembly step with the liquid L frozen inside the cavity 2. The refrigerating liquid L can have been introduced into the cavity 2 in the form of liquid and then frozen with the cavity 2, or have been frozen separately in a shape fitting in the cavity 2. Preferentially, the liquid L only partially fills the cavity 2, for example half.

The internal walls of the cavity 2 can advantageously be covered with a hydrophilic porous material, such as cellulose or a polymer for example. This material can be glued to the walls of the cavity 2 during its manufacture or put in place at the same time as the frozen liquid L.

The refrigerating liquid L contained in the internal cavity 2 can be water, or preferentially water containing an additive reducing its solidification temperature, such as NaCl for example. With such an additive, it is possible to improve the speed of cooling of the drink by lowering the temperature of the cavity 2 (the heat exchanger) below 0° C. when the refrigerating liquid L is water.

According to one particularity of the invention, the internal cavity 2 contains only the refrigerating liquid L and the vapours of the said liquid L, that is to say the liquid L was previously degassed before being introduced into the cavity 2. This degassing can be provided in particular by boiling at atmospheric pressure, following by a boiling by pressure reduction to a few millibars.

In other words, the partial pressure in the internal cavity 2 of the gases other than the vapour of the refrigerating liquid L, before connection of the cavity 2 to the external pumping means 50, is maintained below or equal to 3 millibar. This particularity provides a good evaporation rate whilst avoiding limiting the evaporation reaction with any non-adsorbable gases which might be contained in the cavity 2.

The cavity 2 has geometric particularities such that its volume to surface ratio is one third to one seventh of the volume to surface ratio of the package 10. Several geometric configurations are possible for producing the cavity 2.

Figure 1:
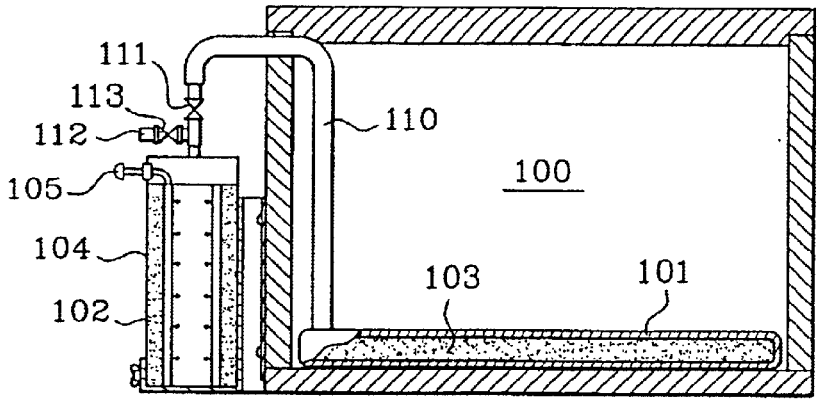
Fig. 1 PRIOR ART
Figure 2:
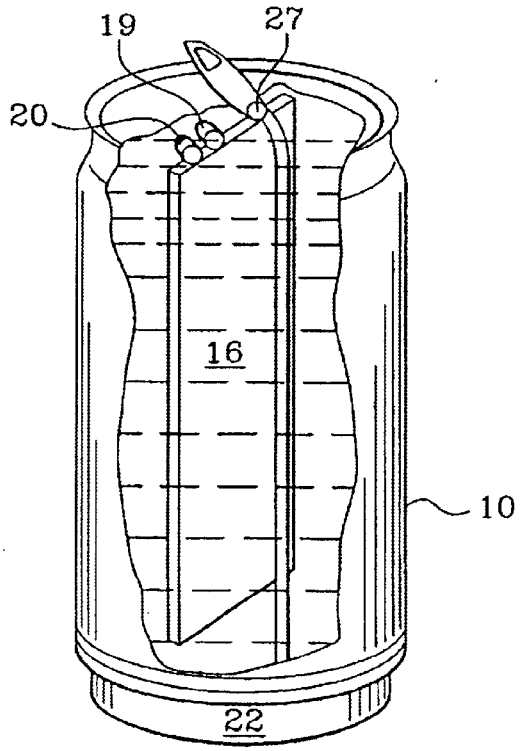
Fig. 2 PRIOR ART
Figure 3:
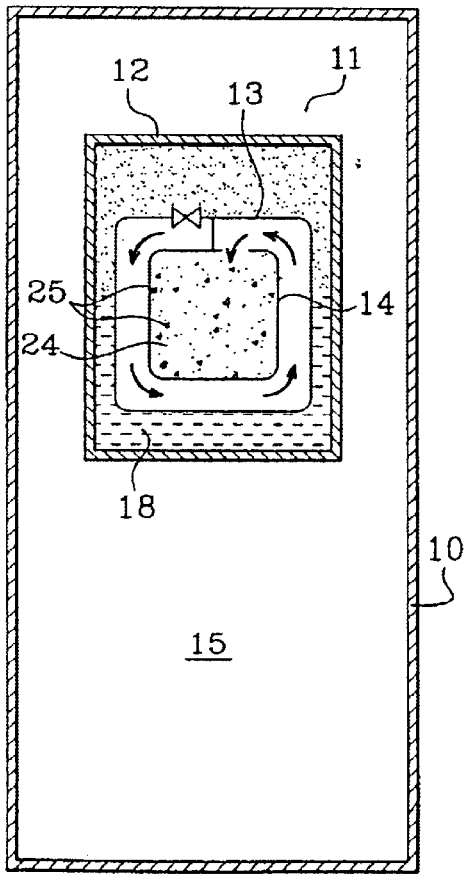
Fig. 3 PRIOR ART
Figure 4:
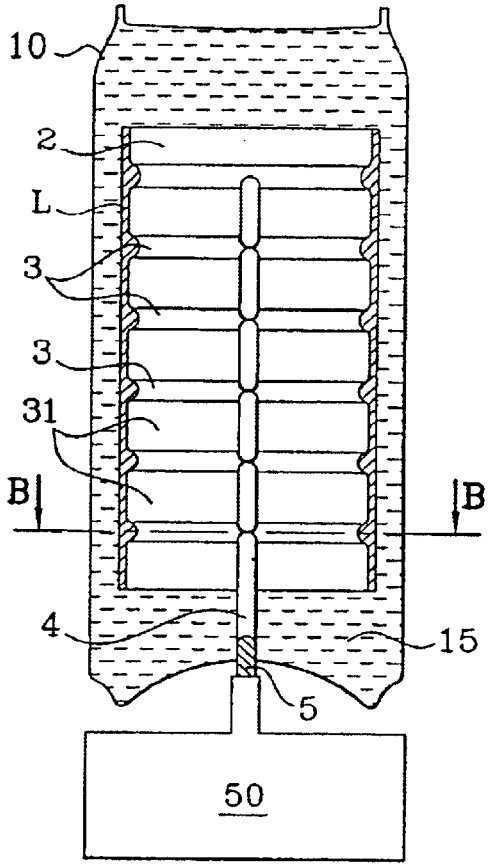
FIG. 4 is a schematic view in transverse section along AA of a drinks package according to a second embodiment of the invention.
Figure 5:
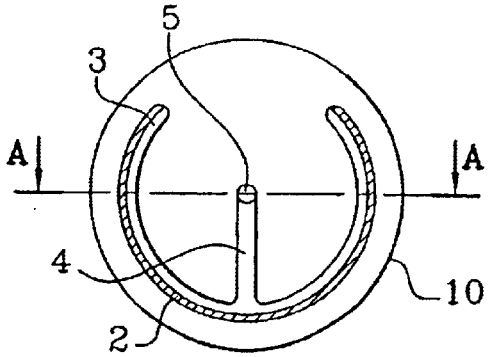
FIG. 5 is a schematic view from below along BB in FIG. 4.

According to a first possible configuration, with reference to FIGS. 4 to 6, the geometry of the cavity 2 favours a large heat exchange surface with the drink to be refrigerated for a small volume occupied in the package 10.

According to this embodiment, the cavity 2 has a tubular structure principally consisting in pumping tubes 3 which form ribs held between them by plates 31 and containing the refrigerating liquid L to be evaporated. The internal cavity 2 can advantageously have the shape of an arc of a circle matching the shape of the can 10.

The tubular structure of the cavity 2 can be obtained by producing the two faces (portion of tubes and plates) separately by pressing. The frozen liquid L is then introduced between the two faces, which are assembled in order to form the cavity 2.

The cavity 2 containing the refrigerating liquid L is then fixed to the package 10, by cold crimping of two cones one in the other, adhesive bonding or any other technique. Cold crimping means the connection of two pieces put in contact at different temperatures and which expand or contract in order to be fixed together.

In order to guarantee a good vacuum in the cavity 2, the assembly step can be carried out, for example, under air vacuum and under saturation vapour pressure of the refrigerating liquid L. If the assembly is carried out at atmospheric pressure, it is then necessary to provide a step of pumping the cavity 2 before closure of the latter.

The connection means 5, which make it possible to connect the internal cavity 2 to the external pumping means 30, are illustrated in detail in FIGS. 6*a* and 6*b*.

These connection means 5 associate a tube 4 extending the cavity 2 and the bottom of the package 10 by means of complementary crimped conical shapes (51 and 52) and (53 and 54). It is the connection means 5 which provide the closure of the package 10 and/or of the cavity 2. It can also be envisaged producing the connection means 5 in the lid of the package 10 rather than in its bottom.

A seal-removal recess is also produced on the connection means 5, that is to say a local thinning of the structure, to allow the cutting of an opening in the internal cavity 2 using seal-removal means associated with the external pumping means 50.

According to another possible configuration, with reference to FIGS. 7 and 8, the cavity 2 constitutes a double bottom of the package 10. This configuration repeats most of the particularities of the first. The geometry of the cavity 2 favours the establishment of large convection currents in the drink in order to provide rapid cooling. It has, for example, a conical shape in vertical section (FIG. 7) and a star structure in horizontal section (FIG. 8). The cavity 2 is fixed directly to the bottom of the package or to its lid, by adhesive bonding for example.

The connection means 5 are similar to those described previously, as well as the associated seal-removal means.

The double-bottom structure of the cavity 2 can be obtained by pressing with the package 10. The refrigerating liquid L preferentially being introduced frozen at the bottom of the can 2 before this assembly step.

The manufacturing method according to the invention makes it possible to effect the assembly of the cavity 2 with the refrigerated liquid L in the package 10 whilst maintaining the partial pressure of the non-adsorbable gases in the cavity 2 at a low level, that is to say much less than 3 millibar.

This objective is achieved by freezing the liquid L in the cavity 2 and performing the assembly step under air vacuum or at atmospheric pressure followed by a pumping step before closure of the cavity 2.

For this, the standard equipment of can manufacturers 10 can easily be adapted, the manufacturing steps being practically unchanged compared with the manufacture of a standard can.

The invention requires in fact means of degassing and freezing refrigerating liquid L. For this purpose, heating and pumping means are necessary, which does not represent any difficulty, or large investment.

The invention also requires means of assembling the cavity 2 in the package 10 and means of making the vacuum in the cavity 2. The assembly means consist essentially of adhesive bonding, crimping and cold pressing means, which are techniques already used in the standard equipment of can manufacturers. The means of making the vacuum in the cavity 2 can simply be means of pumping the cavity before it is closed, the refrigerating liquid L being frozen, or means for assembling under vacuum, which represent equipment which is a little more specific but used in many industries.

What is claimed is:

1. A method for manufacturing a self-refrigerating drinks package, comprising a step of assembling a refrigeration means inside a package, the refrigeration means comprising a cavity containing a refrigerating liquid able to evaporate under the effect of a negative pressure and providing in the package a connector that connects the cavity to a pump external to the package, wherein the assembly step is performed with the cavity containing the refrigerating liquid in a frozen state.

2. The manufacturing method according to claim 1, wherein the refrigerating liquid was degassed prior to its introduction into the internal cavity so as to obtain a partial pressure of the non-adsorbable gases in the internal cavity of less than 3 millibar.

3. The manufacturing method according to claim 1, wherein the method further comprises:

producing at least part of the cavity, filling the cavity with a refrigerating liquid, freezing the refrigerating liquid, and assembling the cavity in the package provided with the connector.

4. The manufacturing method according to claim 1, wherein the method further comprises:

producing at least part of the cavity, freezing a refrigerating liquid in a shape fitting in the cavity, filling the cavity with the frozen refrigerating liquid, and assembling the cavity in the package provided with the connector.

5. The manufacturing method according to claim 1, wherein the assembly of the internal cavity in the package is carried out by cold crimping.

6. The manufacturing method according to claim 1, wherein the assembly of the internal cavity in the package is carried out by adhesive bonding.

7. The manufacturing method according to claim 1, wherein the assembly of the cavity in the package is carried out under air vacuum.

8. The manufacturing method according to one of claim 1, wherein the assembly of the cavity in the package is carried out at atmospheric pressure by pumping the cavity before closure of the cavity.

9. The manufacturing method according to claim 1, wherein the connector forms a conical structure closing off the cavity and is provided with a seal-removal recess.

10. The manufacturing method according to claim 1, wherein the connector is disposed in a bottom of the package.

11. The manufacturing method according to claim 1, wherein the refrigerating liquid water.

12. The manufacturing method according to claim 1, wherein the refrigerating liquid is water containing an additive lowering its solidification temperature.

13. The manufacturing method according to claim 1, wherein the refrigerating liquid partially fills the internal cavity.

14. An apparatus for implementing the manufacturing method according to claim 1, comprising:

means of freezing the refrigerating liquid, means of assembling a cavity containing the frozen refrigerating liquid in a package, and means of producing vacuum in the cavity.

15. A method for manufacturing a self-refrigerating package, comprising a step of assembling a refrigeration means within a package, the refrigeration means comprising an evaporator chamber provided with connection means and containing a refrigerating liquid able to evaporate under the effect of a vacuum sustained by pumping means through the connecting means, wherein the assembly step closes the evaporator chamber inside the package with the refrigerating liquid in a frozen state.

* * * * *